US010919722B2

(12) United States Patent
Adami

(10) Patent No.: US 10,919,722 B2
(45) Date of Patent: Feb. 16, 2021

(54) REEL UNWINDER WITH SYSTEM FOR LOADING AND UNLOADING THE REELS

(71) Applicant: Guangdong Fosber Intelligent Equipment Co., Ltd., Foshan (CN)

(72) Inventor: Mauro Adami, Viareggio (IT)

(73) Assignee: Guangdong Fosber Intelligent Equipment Co., Ltd., Guangdong (CN)

( * ) Notice: Subject to any disclaimer, the term of this patent is extended or adjusted under 35 U.S.C. 154(b) by 251 days.

(21) Appl. No.: 16/306,811

(22) PCT Filed: Jun. 6, 2017

(86) PCT No.: PCT/CN2017/087322

§ 371 (c)(1),
(2) Date: Dec. 3, 2018

(87) PCT Pub. No.: WO2017/211269

PCT Pub. Date: Dec. 14, 2017

(65) Prior Publication Data

US 2019/0185283 A1 Jun. 20, 2019

(30) Foreign Application Priority Data

Jun. 7, 2016 (IT) ..... UA2016A004142

(51) Int. Cl.
*B65H 19/00* (2006.01)
*B65H 16/00* (2006.01)
(Continued)

(52) U.S. Cl.
CPC ..... *B65H 19/126* (2013.01); *B65H 16/028* (2013.01); *B65H 2301/4186* (2013.01);
(Continued)

(58) Field of Classification Search
CPC ..... B65H 19/00; B65H 19/12; B65H 19/123; B65H 19/126; B65H 16/021;
(Continued)

(56) References Cited

U.S. PATENT DOCUMENTS 4,516,742 A * 5/1985 Townsend ..... B65H 18/04 242/533.5
4,919,353 A 4/1990 Isowa et al.
(Continued)

FOREIGN PATENT DOCUMENTS

DE 3043880 C2 1/1985
DE 4215739 A1 11/1993
(Continued)

*Primary Examiner* — Michael E Gallion
(74) *Attorney, Agent, or Firm* — Breiner & Breiner, L.L.C.

(57) ABSTRACT

Disclosed is an unwinder with system for loading and unloading reels. The unwinder includes a rotating support with a rotation axis and provided with engaging members for engaging the reels. The unwinder further includes a positioning system for loading the reels onto the rotating support and an unloading system for unloading the reels from the rotating support. The positioning system includes a first conveyor for the reels and a pusher configured and arranged to push the reels from the first conveyor towards abutment members defining a pick-up position where the reel is taken by the rotating support. The positioning system and the unloading system are arranged at opposite sides of the rotating support.

26 Claims, 12 Drawing Sheets

(51) Int. Cl.
*B65H 19/12* (2006.01)
*B65H 16/02* (2006.01)

(52) U.S. Cl.
CPC ..... *B65H 2301/41722* (2013.01); *B65H 2301/41726* (2013.01); *B65H 2301/41859* (2013.01); *B65H 2511/51* (2013.01)

(58) Field of Classification Search
CPC ..... B65H 16/028; B65H 2301/41722; B65H 2301/41726; B65H 2301/41859; B65H 2301/4186; B65H 2511/51
See application file for complete search history.

(56) References Cited

U.S. PATENT DOCUMENTS 4,993,652 A * 2/1991 Moeller ..... B65H 19/2215 242/527.3
5,238,352 A * 8/1993 Abe ..... B65H 19/126 104/35
5,417,382 A * 5/1995 Petitjean ..... B65H 19/2223 242/527
5,755,395 A * 5/1998 Gnan ..... B65H 19/126 242/559.1
6,311,823 B1 * 11/2001 Bierbaum ..... B65G 47/34 198/360
7,204,448 B2 * 4/2007 Heikaus ..... B65H 19/2207 242/533.4
7,441,579 B2 10/2008 Adami
10,518,996 B2 * 12/2019 Adami ..... B65H 19/18
2004/0084133 A1 * 5/2004 Adami ..... B65H 19/1836 156/159
2005/0017118 A1 * 1/2005 Finetti ..... B65H 19/126 242/559.1
2006/0137501 A1 * 6/2006 Damo ..... B65H 16/021 83/277
2008/0121749 A1 * 5/2008 McVaugh ..... B60P 3/035 242/399.1
2012/0006931 A1 * 1/2012 Murata ..... B65H 19/126 242/578.1

FOREIGN PATENT DOCUMENTS

DE 102012213967 B3 7/2013
EP 0325498 A1 7/1989
EP 1609749 A1 12/2005
EP 2782857 B1 1/2017
JP S4921211 B1 5/1974
JP 0266043 A 3/1990
WO 2015056215 A1 4/2015

* cited by examiner

REEL UNWINDER WITH SYSTEM FOR LOADING AND UNLOADING THE REELS

FIELD OF THE INVENTION

The present invention relates to machines and devices for processing continuous web materials, such for example, but not limited to, webs or strips for producing corrugated board.

Embodiments described herein also relate to machines or devices for unwinding reels of web material (so-called unwinders).

BACKGROUND TO THE INVENTION

In many industrial fields, it is necessary to process continuously sheets or webs unwound from a reel. Typically, in the corrugated board field, unwinders are commonly used to produce sheets for board boxes or other products, that are provided with a plurality of means for supporting and unwinding the reek of web material, typically flat paperboard. A plurality of webs of corrugated board are fed from so-called corrugators (single facer) to hot surfaces (double facer) for producing multi-layer corrugated board.

The unwinder comprises a splicing device (below also called splicer) for splicing the trailing edge of a web material of a nearly empty roll or reel to the leading edge of a second web material of a new reel. By splicing the trailing edge and the leading edge of the two web materials in an automatic or semi-automatic way, it is possible to make the unwinder, and therefore the line comprising it, operate in a substantially continuous manner.

Modern unwinders and splicers of this type are disclosed for instance in EP 1609749 and in US 2004/0084133, the content whereof is incorporated in the present description.

If there is enough space at both sides of the processing line, the new reels of web material are inserted from a side of the processing line and the empty reels are extracted from the opposite side of the processing line. In some plant layout this is not possible, for example because there is not enough space at both sides of the processing line. This typically occurs when there is an obstacle, for example a wall, or another processing line, or any other obstacle, at a side of the processing line. Thus, 3-positions unwinders have been developed, allowing the reels to be inserted and extracted at the same side of the processing line. Exemplary embodiment of unwinders and processing lines of this type are disclosed in U.S. Pat. No. 7,441,579 and in U.S. Pat. No. 4,919,353, as well as in the two publications mentioned above (EP 1609749 and US 2004/0084133).

The use of 3-positions unwinders of this kind has some drawbacks. For example, they are very bulky, and this affects the overall length of the processing line. Moreover, unwinders of this kind are complex and expensive.

JP-S-4949 21211 discloses an unwinder for reels of web material comprising two pairs of arms rotating around a stationary support. The pairs of arms are used to pick-up a reel of web material, to bring it into an unwinding position, to supply material and to unload the reel onto a stationary unloading surface. The reel is brought towards the unwinder by making it roll on a surface until it is arranged on a vertically movable V-shaped cradle. The cradle is raised by means of a lift table arranged in a pit below the floor. The lift table shall have a very strong structure in order to raise the heavy reels, that can be some tons in weight, for example 3-5 tons. For this reason, the lift tables and the actuators thereof shall have large dimensions. The reels shall be brought onto the cradle by making them roll parallel to the machine direction, i.e. to the direction along which the web material will be fed. It is not possible to introduce the reels laterally, i.e. orthogonally to the machine direction. Therefore, it is difficult to lay out the processing line.

DE-A-4207199 discloses a plant where the reels can be inserted laterally, i.e. orthogonally to the machine direction. This known plant comprises an unwinder which comprises only one pair of pivoting arms to pick-up the reel from one or the other of two pick-up positions. The reel is inserted into one pick-up position or into the other by means of a respective shuttle. Each shuttle both transports the new reel into the loading position, and takes the empty reel away. Each shuttle has a V-shaped cradle to house the reel. The reels are brought towards the side of the processing line with the axis thereof oriented in machine direction, i.e. rotated by 90° with respect to the position that the reel shall take on the unwinder. The reel is arranged on a rotating table with a V-shaped cradle, arranged spaced from the unwinder and at the side of the processing line. The shuttles transfer each reel from the rotating table to the unwinder and vice versa. The rotating table is controlled so as to rotate by 90° in a horizontal plane and to orient the reel with the axis thereof in the suitable position for being transferred onto the shuttle and, therefrom, onto the unwinder. The shuttles and the rotating table are provided with pivoting movements in order to facilitate the transfer of the reels from the rotating table to the shuttles and vice versa. In order to transfer the reel from the shuttle to the unwinder, the shuttle shall be aligned with the arms of the unwinder and the arms shall be lowered towards the shuttle. The system is very complex and bulky. Moreover, it is not possible to take reels of variable diameter from the shuttle.

DE-A-19736491 discloses a shuttle for transporting paper reels, and a system to facilitate the loading of the reels onto the shuttle. The system for loading the reels onto the shuttle is provided with two series of rollers forming a cradle with variable arrangement. The shuttle is positioned between the two series of rollers. A series of rollers is fixed, while the other series of rollers pivots in order to allow the reel to roll beyond the rollers and to be positioned onto the shuttle. Then, the movable rollers are raised and form, together with the fixed rollers, a V-shaped cradle for centering the reel on the shuttle. This document does not provide any means for loading the reels onto, or unloading the reels from, an unwinder.

There is therefore the need for providing unwinders for unwinding reels of web material, for example paperboard, that are simpler and have more compact dimensions.

SUMMARY OF THE INVENTION

In order to overcome, partially or completely, one or more of the problems of the known unwinders, an unwinder is provided for unwinding reels of web material, comprising: a rotating support with a rotation axis and provided with engaging members for engaging the reels; a reel positioning system for loading the reels onto the rotating support; and an unloading system for unloading the reels from the rotating support.

Advantageously, the positioning system comprises a first conveyor for the reels and a pusher configured and arranged to push the reels from the first conveyor towards abutment members defining a pick-up position where the reel is taken by the rotating support. Moreover, the positioning system and the unloading system are arranged at opposite sides of the rotating support.

In the pick-up position, the reel axis is approximately arranged on the circular path of the engaging members, for example cones or tailstocks, with which the rotating support is provided. In this way it is possible, by means of the pusher, to arrange each reel in the suitable position for being taken by the engaging members, independently of the reel diameter. This allows handling reels of significantly different diameters.

The first conveyor may comprise a continuous flexible member, for example a chain or a belt. The first conveyor may comprise an active upper branch and a lower return branch. The active branch may be arranged level with the floor, in order that the first conveyor does not hinder operators and/or service vehicles, for example forklifts or the like.

In some embodiments, the positioning system is advantageously arranged below the floor.

In practical embodiments, the first conveyor has a reel feeding movement substantially parallel to the rotation axis of the rotating support, and the pusher has a movement substantially orthogonal to the rotation axis of the rotating support. The reels can be therefore inserted into the processing line, and extracted from the processing line, orthogonally to the longitudinal extension of the line.

In advantageous embodiments, the pusher comprises an arm pivoting around an articulation axis substantially parallel to the rotation axis of the rotating support. The articulation axis may be arranged at a height lower than the first conveyor, in order to reduce overall bulk.

In some embodiments, the abutment members comprise two abutment elements, spaced from each other along a direction substantially parallel to the rotation axis of the rotating support. Detectors may be associated with the two abutment elements, detecting when each abutment element has achieved, under the reel thrust, a given position. In this way, the correct positioning of the reel axis with respect to the rotation axis of the rotating support is ensured.

In advantageous embodiments, the unloading system comprises an unloading surface pivoting around a pivoting axis substantially parallel to the rotation axis of the rotating support.

The unloading system may also comprise a second conveyor. In some embodiments, the unloading surface and the second conveyor are advantageously arranged so as to make the reels roll from the rotating support along the unloading surface to the second conveyor.

The second conveyor may move parallel to the first conveyor.

The second conveyor may comprise a continuous flexible member, for example a chain or a belt. The second conveyor may comprise an active upper branch and a return lower branch. The active branch may be arranged level with the floor, in order that the second conveyor does not hinder the operators and/or the service vehicles, for example forklifts or the like.

In some embodiments, the unloading system is advantageously arranged below the floor.

In some embodiments, in order to control the rotating support very reliably during the reel unloading step, the unloading surface may be associated with detecting members, configured to detect the angular position of the unloading surface and to control the rotation of the rotating support accordingly.

The detectors interface, for example, a control unit configured to control the movement of the rotating support and the stop thereof in a position where the reel is released. The release position may be defined according to the angular position of the unloading surface.

In some embodiments, the unloading surface is functionally connected to at least one actuator arranged and configured to make the unloading surface pivot into a rejecting position for rejecting the reel towards the second conveyor.

Further advantageous features and embodiments of the unwinder are described below with reference to the attached drawing, and in the attached claims, forming an integral part of the present description.

BRIEF DESCRIPTION OF THE DRAWINGS

The invention and the many advantages resulting therefrom will be better understood from the description below of some embodiments, set forth with reference to the accompanying drawing, where.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
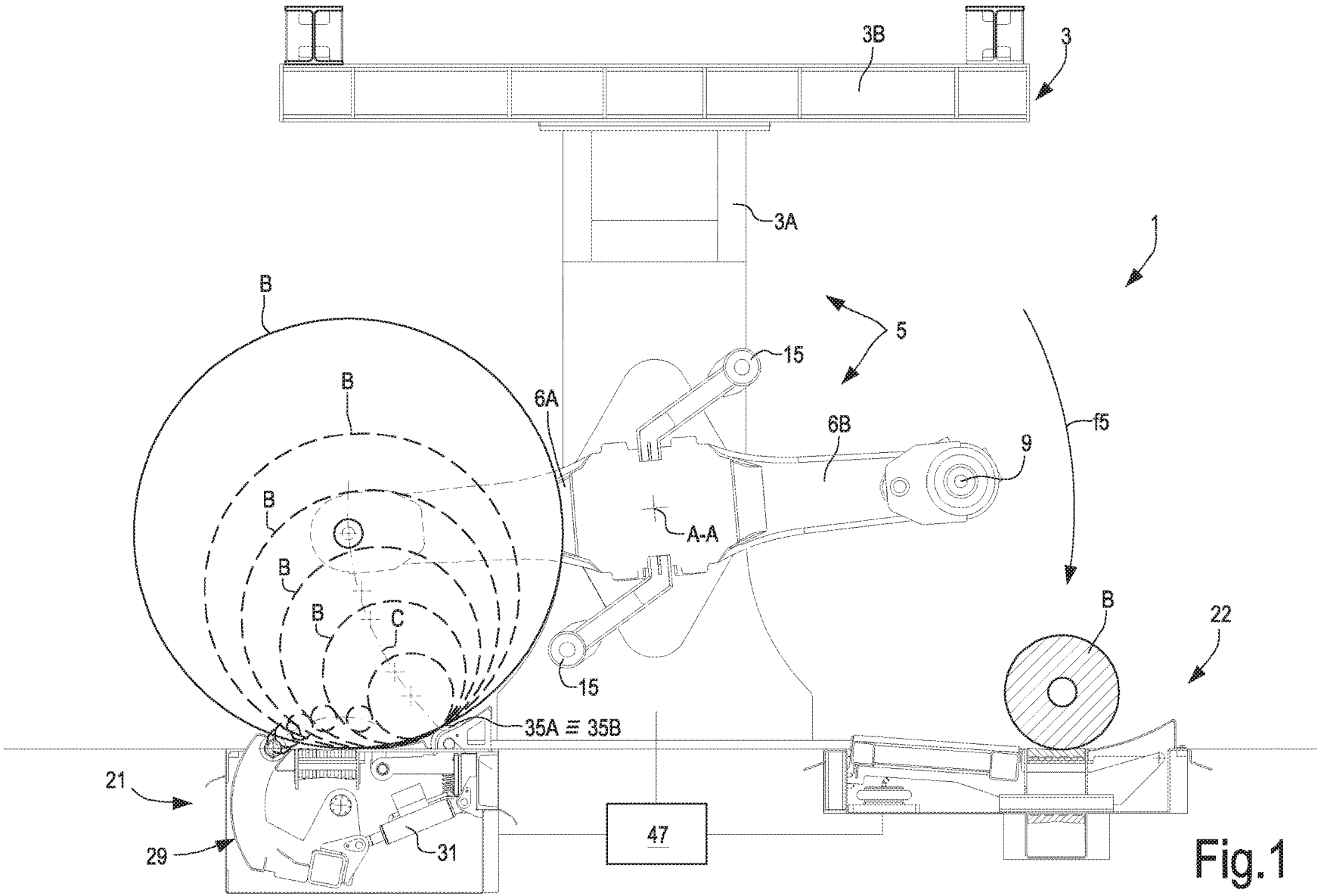
FIG. 1 shows a side view of an unwinder according to an embodiment.

With initial reference to FIG. 1, number 1 indicates, as a whole, an unwinder for unwinding reels of web material, for example paperboard reels. The unwinder may be part of a corrugated board production line comprising: a plurality of unwinders, one or more corrugators (single-facer) receiving two smooth paperboard webs and producing a composite web comprised of a smooth paperboard web glued onto a fluted paperboard web; a series of hot surfaces (double-facer) that glue composite webs, coming from one or more corrugators, to each other and to a smooth paperboard web. Typically, the line also comprise a dry end section where the composite web material, formed by a plurality of smooth paperboard sheets alternating corrugated paperboard sheets, is scored and slit, longitudinally and then transversally, in order to obtain single sheets for the production of board boxes or the like.

In the illustrated embodiment, the unwinder 1 comprises a bearing structure 3, a rotating support 5 for supporting two reels of web material, one reel being processed and the other one waiting for being processed; and a splicing device, for example of a known type, not shown.

The two web materials may be spliced together, for example, when the first roll, i.e. the first reel from which the first web material is fed, is nearly empty and shall be replaced with a new one. However, also in other situations it could be necessary to splice a first web material coming from a first reel, i.e. roll of paper feeding into the corrugator, with the leading edge of a second web material coming from a new reel. This occurs, for example, when it is necessary to produce several types of corrugated board, for example if it is necessary to pass from a type of corrugated board to another requiring the use of a web material different from the first one in composition, thickness, width or other features.

The rotating support 5 may comprise two pairs of arms 6A and 6B. Each arm 6A, 6B carries a tailstock 9, configured to engage the ends of a respective reel B of wound web material, for example paperboard. The arms of each pair are parallel to each other and arranged side-by-side, so that in the side views shown in the drawing only one arm per each pair 6A, 6B is visible, as the two arms of each pair are arranged over each other.

The tailstocks 9, coaxial with each other, are provided with an extraction and retraction movement parallel to the axis thereof and are provided with brakes controlling the unwinding of the respective reel of web material, usually unwound through traction. The brakes allow keeping the web material suitably tensioned during unwinding. The rotating support 5 is provided with a rotation movement according to th arrow f5 around a substantially horizontal rotation axis A-A. The rotation around the axis A-A according to arrow f5 may be controlled by one or more motors, not shown. The rotating support 5 may also comprise a pair of guide rollers or return rollers 15 in order to guide the web material during the various steps of the operation cycle.

The bearing structure 3 may have uprights 3A and crossbars 3B. Guide rollers, not shown, for guiding the web material, and the splicer, that is not part of the present invention, are supported on the crossbars 3B.

Figure 2:
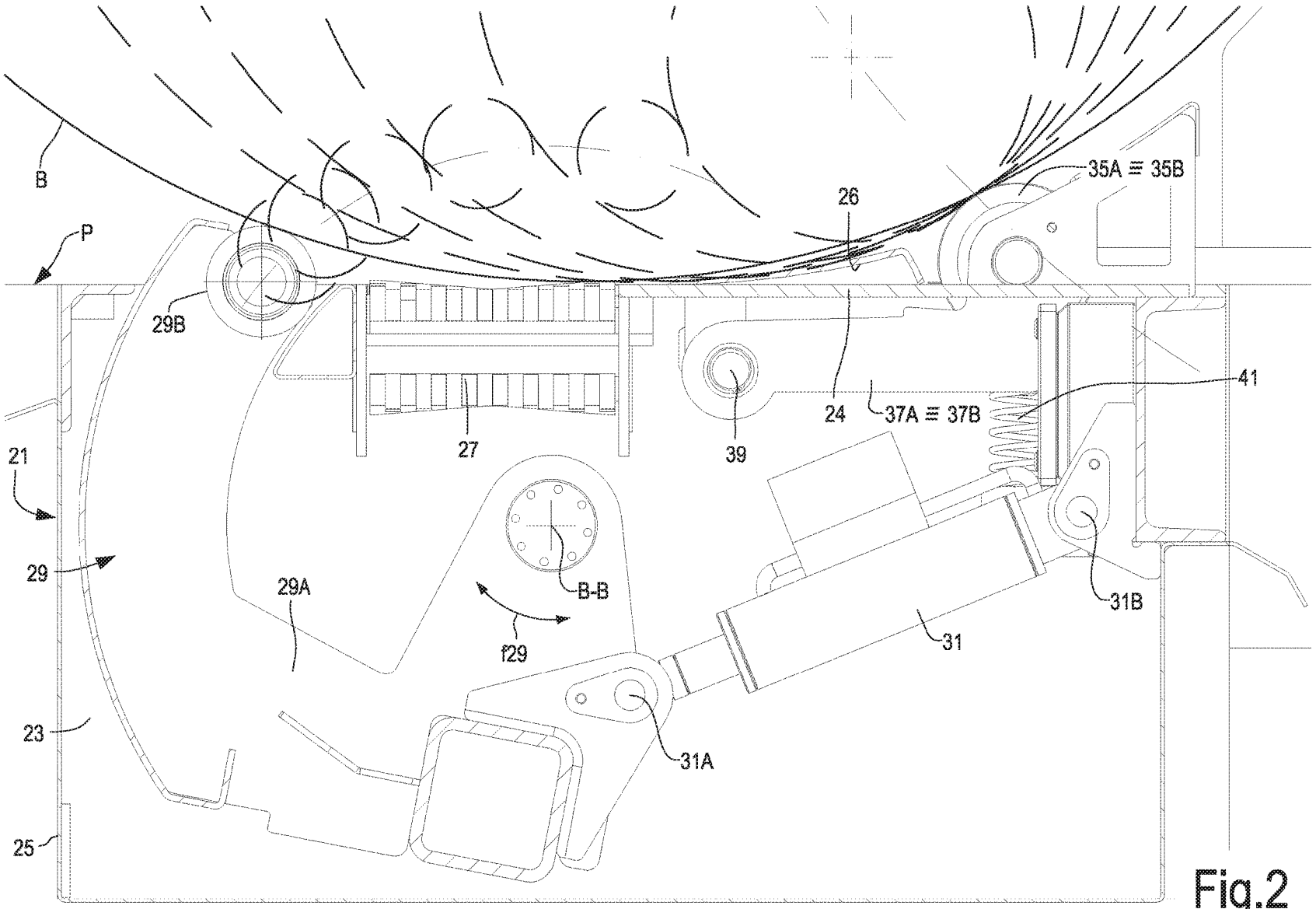
FIG. 2 shows an enlargement of the reel positioning system of the unwinder of FIG. 1.
Figure 3:
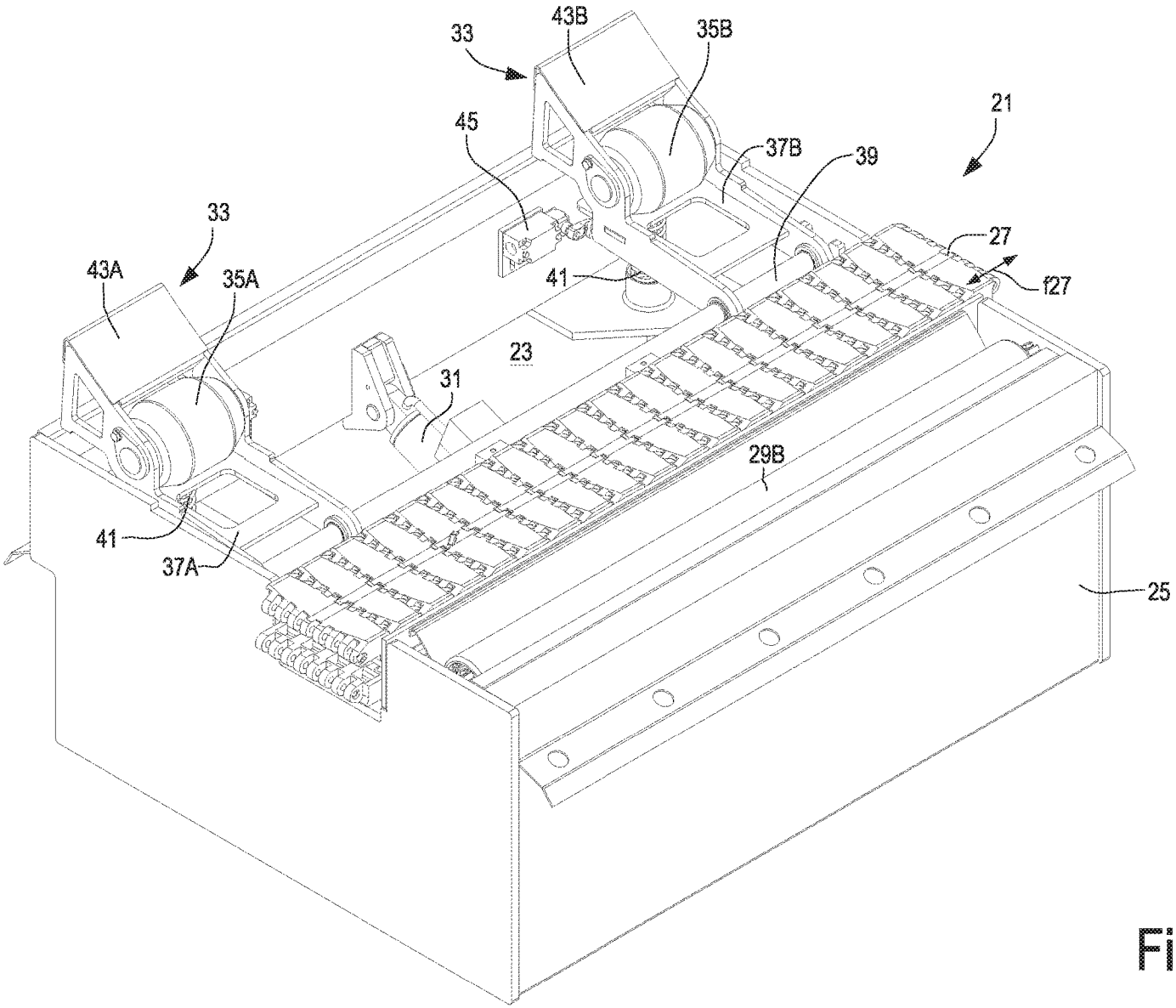
FIG. 3 is an axonometric view of the positioning system of FIG. 2 in a first arrangement.
Figure 4:
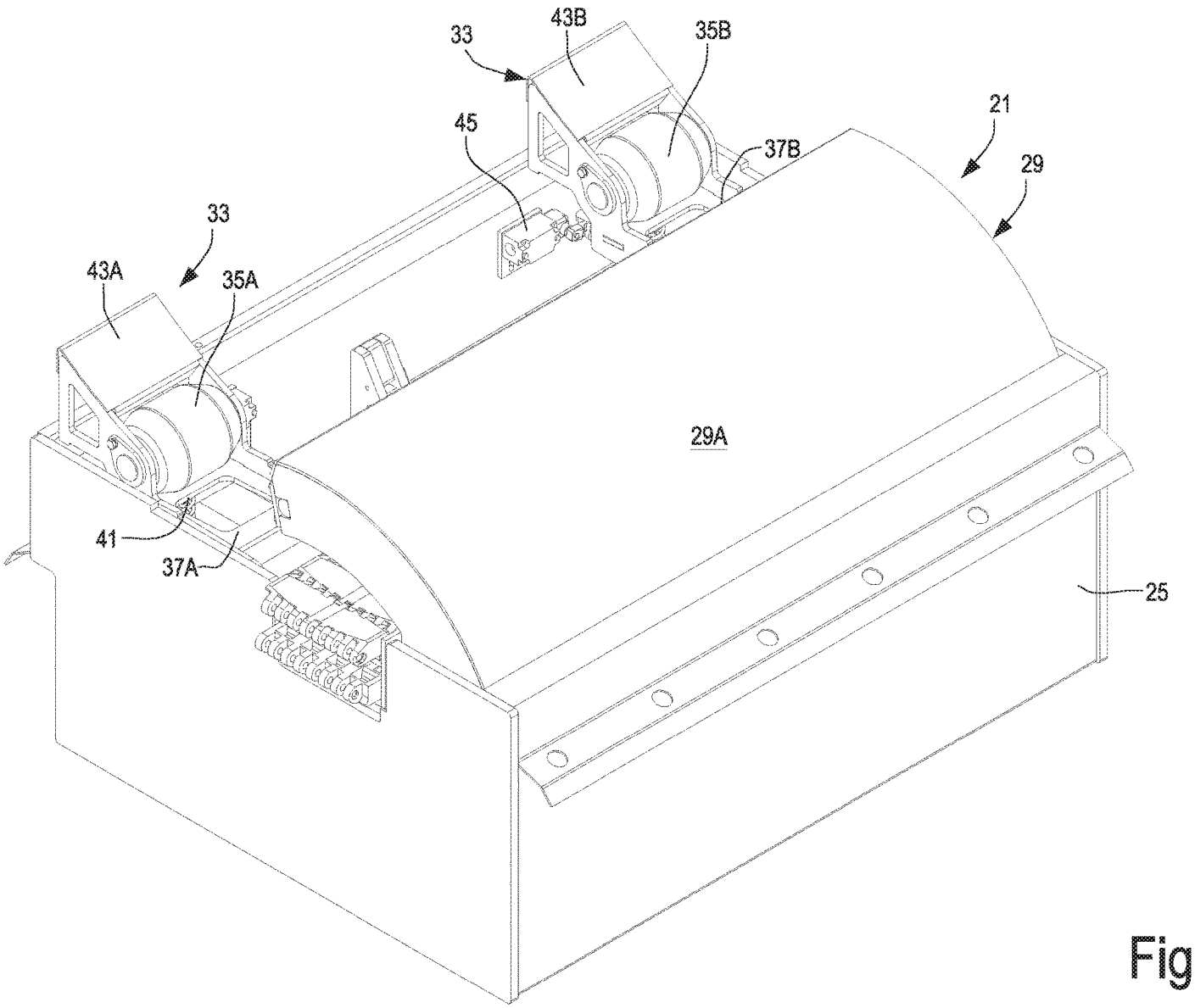
FIG. 4 is an axonometric view of the positioning system of FIG. 2 in a second arrangement.

The rotating support 5 is associated with a positioning system 21 for loading the reels B onto the rotating support 5, and an unloading system 22 for unloading the reels from the rotating support 5. FIG. 2 shows an enlarged cross-section of the positioning system 21, while FIGS. 3 and 4 show two axonometric views of the system, described in detail below. The positioning system 21 and the unloading system 22 are arranged at opposite sides of the rotating support. More exactly, the positioning system 21 and the unloading system 22 are arranged at opposite sides of a vertical plane containing the rotation axis A-A of the rotating support 5.

In the illustrated embodiment, the positioning system 21 is housed below a floor P, in a volume 23 that is surrounded by a casing 25 and is partially covered by a cover or plate 24. The cover 24 is shown only in FIGS. 1 and 2, while it has been removed in FIGS. 3 and 4 in order to make the inside of the volume 23 visible.

In some embodiments, the positioning system 21 comprises a conveyor 27, for example a chain or a belt, movable according to a feeding direction of the reels B, indicated with f27 in FIG. 3. In the embodiment illustrated in the attached figures, the reel feeding direction f27 is substantially parallel to the rotation axis A-A of the rotating support 5.

The positioning system 21 also comprises a pusher 29 to push the reels 13 from the first conveyor 27 towards a position where they are engaged by the tailstocks 9 of the arms 6A, 6B of the rotating support 5. In the illustrated embodiment, the pusher 29 comprises an arm 29A carrying a roller 29B. The roller 29B is mounted idle on the arm 29A and has an axis preferably parallel to the rotation axis A-A of the rotating support 5. The pivoting movement of the pusher 29 is approximately orthogonal to the rotation axis A-A of the rotating support 5.

In the illustrated embodiment, the arm 29 is hinged around an articulation or rotation axis B-B, preferably arranged below the floor P, for example below the conveyor 27. By means of an actuator 31, for instance a hydraulic cylinder-piston actuator, the arm 29A is made pivot according to the double arrow f29 (FIG. 2) around the articulation axis B-B, from a retracted position (FIG. 3), where the arm 29A and the roller 29B are in the space 23, to an extracted position (FIG. 4). The actuator 31 may be hinged at 31A to the pusher 29 and, at 31B, to an element fixed with respect to the floor P.

FIG. 4 illustrates a position where the arm 29A of the pusher 29 is extracted from the space 23 and is therefore in the position where it can push the reel B into a position where it is loaded by means of the tailstocks 9 of the rotating support 5.

The positioning system 21 also comprises abutment members defining a pick-up position where the reel B is taken by the rotating support 5. In the illustrated embodiment, the abutment members, indicated as a whole with number 33, comprise two abutment elements 35A, 35B for the reel B. The abutment elements 35A, 35B may comprise, for example, idle rollers mounted around rotation axes preferably parallel to the axes A-A and B-B. The rollers 35A, 35B are preferably coaxial with, and spaced from, each other along the common rotation axis. In the illustrated embodiment, as visible in particular in FIGS. 3 and 4, the rollers 35A, 35B are approximately shaped like a barrel, i.e. with rounded base edges in order not to hinder any axial sliding of the reel B on the side surfaces of the rollers 35A, 35B.

In some embodiments, each abutment element 35A, 35B is resiliently biased towards a rest position, shown in FIGS. 3 and 4. For example, each abutment element may be carried by a respective oscillating member 37A, 37B. The two oscillating members 37A, 37B may be hinged on a common shaft 39, the axis thereof being substantially parallel to the axis A-A.

In the illustrated embodiment, each oscillating member 37A, 37B is resiliently biased upwards, towards a rest position, by means of a respective compression spring 41 or other suitable member.

A respective rest surface 43A, 43B for the reels B may be associated with each abutment element 35A, 35B.

The angular position of each oscillating member 37A, 37B may be detected by means of position detectors, for example micro-switches 45. Advantageously, one position detector is provided for each oscillating member. In particular, the detectors 45 may be configured to detect when the respective oscillating member 37A, 37B (and therefore the corresponding abutment element 35A, 35B) achieves a position of maximum lowering under the thrust of a reel B, as it will be better described below with reference to FIGS. 7A to 7F. The detectors 45 may interface a programmable central control unit, schematically indicated with number 47 in FIG. 1, which, in turn, interfaces also the motor controlling the rotation of the rotating support 5 around the rotation axis A-A, the actuator for rotating or pivoting the pusher 29, as well as members, described below, of the unloading system 22.

Details on the operation of the positioning system will be described below with reference to FIGS. 7A to 7F.

Figure 5:
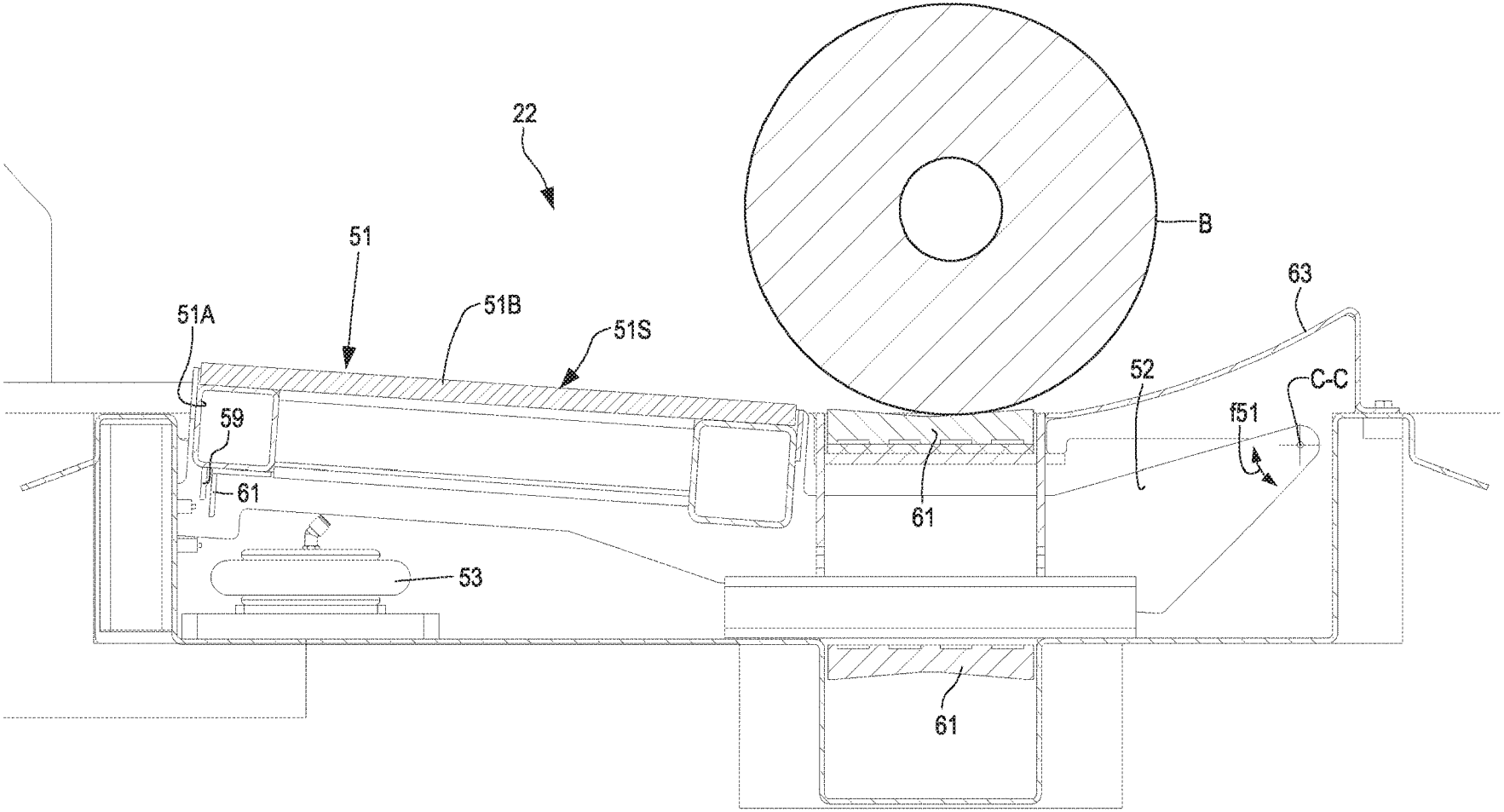
FIG. 5 shows an enlargement of the unloading system of the unwinder of FIG. 1.
Figure 6:
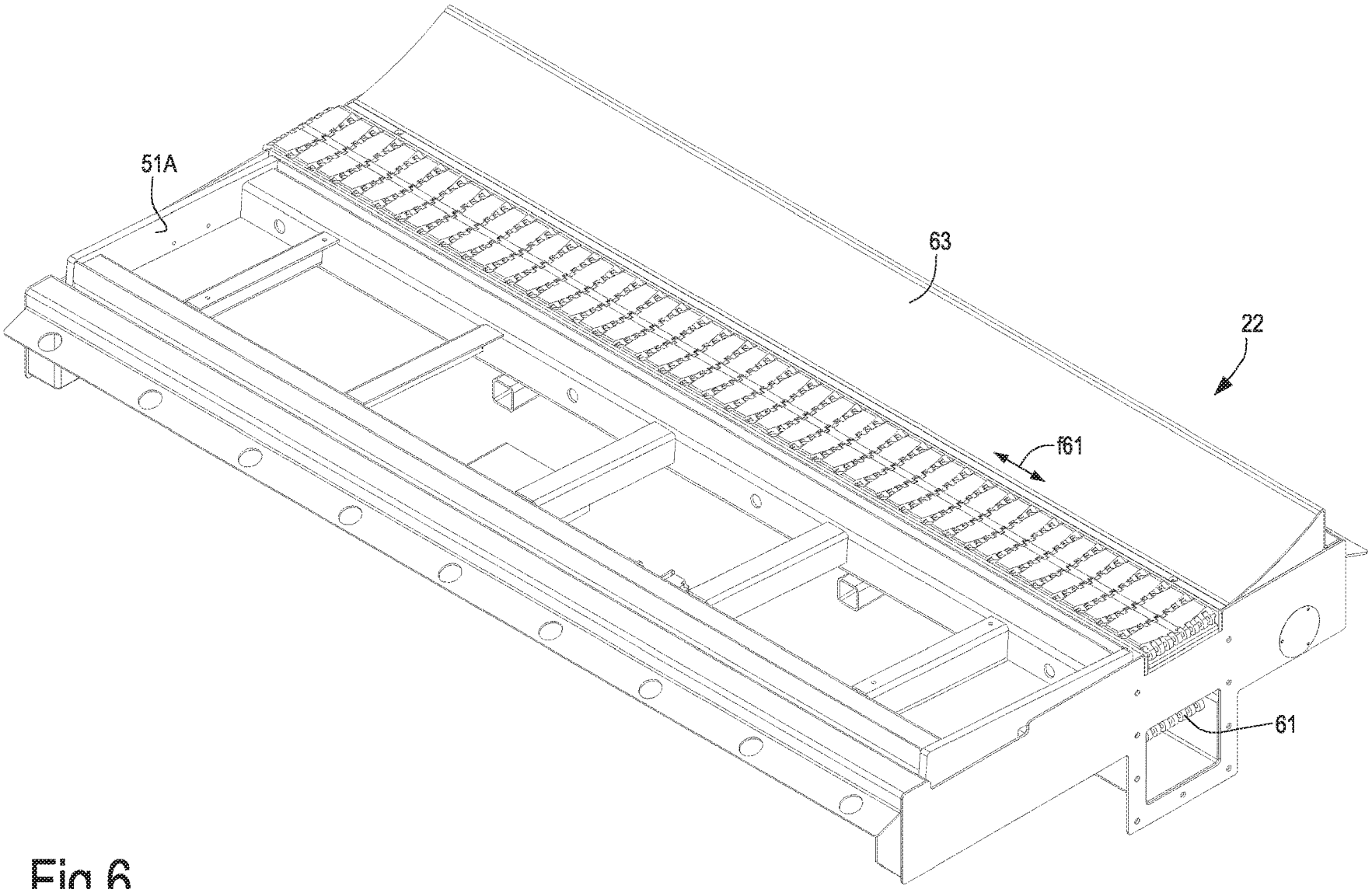
FIG. 6 is an axonometric view of the unloading system of FIG. 5.

The unloading system 21 is illustrated in greater detail in FIGS. 5 and 6.

In the illustrated embodiment, the unloading system 22 comprises an inclined pivoting unloading surface 51, shown in FIG. 5 and partially omitted in FIG. 6. In FIG. 6 only the frame 51A is shown, onto which a plate 51B is applied, visible in FIG. 5 and omitted in FIG. 6, which forms the upper surface of the pivoting unloading surface 51.

The pivoting unloading surface 51 is articulated around an axis C-C preferably substantially parallel to the rotation axis A-A of the rotating support 5.

One or more actuators 53 are associated with the pivoting unloading surface 51, for purposes that will be explained below.

The unloading system 22 may also comprise a second conveyor 61, for example a chain or a belt. The second conveyor 61 may be movable in a direction f61, approximately parallel to the axis A-A and to the axis C-C. The active branch, i.e. the upper branch of the second conveyor 61, defining the transport height of the second conveyor 61, may be arranged at a height greater than the pivoting axis C-C.

The pivoting unloading surface 51 may take a plurality of positions, which can be detected by means of suitable detectors. In some embodiments, three angular positions of the pivoting unloading surface 51 are detected. For example, two micro-switches may be provided, schematically indicated with 55 and 57, cooperating with followers 59, 61 integral with the inclined unloading surface 51. The detectors 55, 57 may interface the programmable central control unit 47 and may be arranged so as to detect three angular positions of the pivoting unloading surface 51, for example a first angular position, where the inclined surface 51S of the pivoting unloading surface 51 forms an angle $\alpha 1$ with the horizontal, a second position, where this angle is equal to $\alpha 2$, and a third position, where this angle is equal to $\alpha 3$. The angles $\alpha 1$, $\alpha 2$ and $\alpha 3$ are, for example, 4°, 2° and 1° with respect to the horizontal.

The system for detecting three angular positions allows the operation of the unloading system for the reels B described below.

The pivoting unloading surface 51 is carried by arms 52 hinged at C-C, shaped so as to allow the second conveyor 61 to pass above the same arms, in order that the upper branch of the second conveyor 61 is approximately aligned with the surface 51S of the pivoting unloading surface 51.

A concave metal sheet 63 may be arranged at the side of the second conveyor 61 opposite with respect to the side where the pivoting unloading surface 51 is arranged, in order to stop the reel B that is unloaded from the rotating support 5 onto the second conveyor 61 as described below.

FIGS. 7A to 7F show the movements of the various members of the unwinder 1 described above to handle reels of web material, for example paperboard.

Figure 7A:
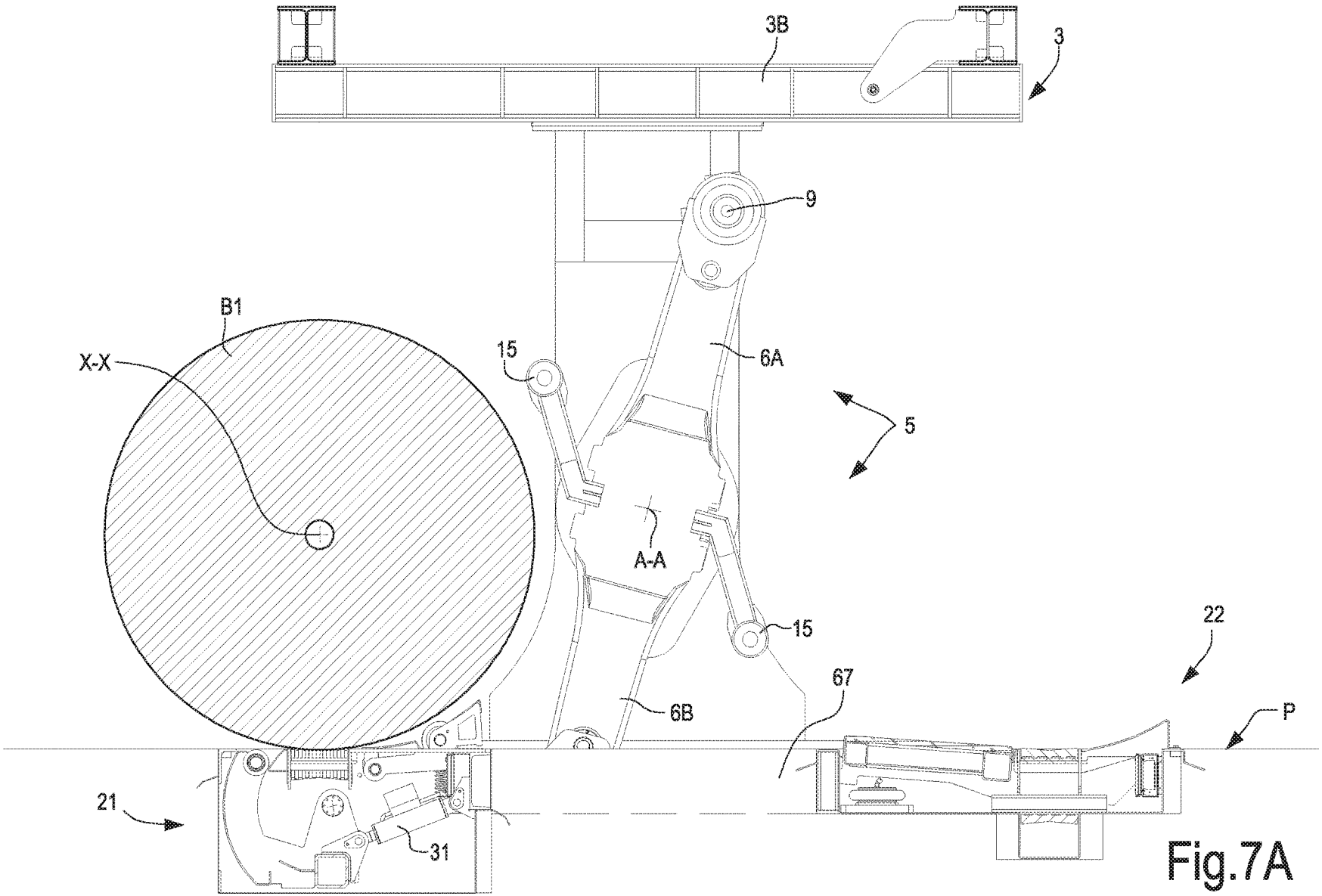
FIGS. 7A to 7F show an operation sequence of the unwinder.

FIG. 7A shows a condition where a first reel B1 has been carried into the loading area above the positioning system 21 by the first conveyor 27. The reel B is in an intermediate position between the two arms 6A of the rotating support 5.

When the reel B1 rests on the first conveyor 27, the axis X-X of the reel B1 lies approximately on a vertical plane passing through the centerline of the first conveyor 27. The position of the axis X-X varies according to the diameter of the reel B1 and is not necessarily arranged on the circular path (indicated with C in FIG. 1) of the tailstocks 9 of the rotating support 5 when this latter rotates around the axis A-A. In order to allow the reel B1 to be engaged by the tailstocks 9, it is therefore necessary to bring the reel B1 in a suitable position, so that the reel axis X-X is on the circular path C followed by the tailstocks 9. To this end, the pusher 29 of the positioning system 21 is used.

Figure 7B:
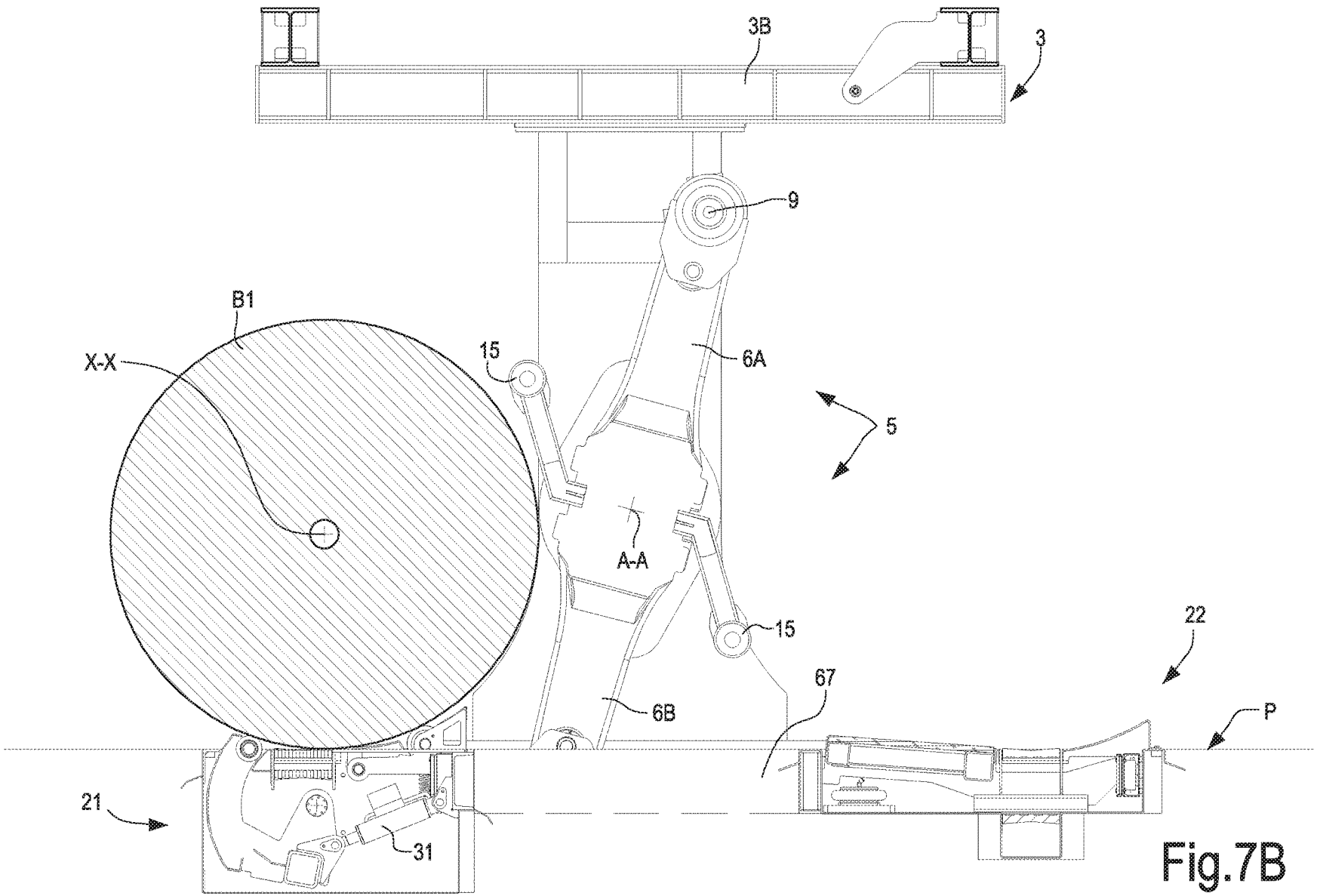

As it is shown in FIG. 7B, the reel B1 is pushed by the pusher 29 until to rest onto the two abutment elements 35A, 35B. The movement of the pusher controlled by the actuator 31 is controlled for example by the programmable central control unit 47 according to the signal given by the two detectors 45 associated with the oscillating members 37A, 37B. The suitable position of the reel B1 for being taken by the tailstocks 9 is achieved when both the abutment elements 35A, 35B have been lowered, under the thrust of the reel B1, until to achieve the lower position, detected by the detectors 45. If the reel B1 is arranged on the first conveyor 27 with the axis thereof not parallel to the rotation axis A-A of the rotating support 5, the thrust exerted by the pusher 29 up to the final position, determined by the achievement of the position of maximum lowering, of both the abutment elements 35A, 35B, causes the adjustment of the position of the reel B1. When both the detectors 45 detect that the abutment elements 35A, 35B have achieved the respective lowered position, the movement of the pusher 29 stops, as the reel B1 is arranged with the axis thereof substantially parallel to the axis of the rollers 35A, 35B and therefore substantially parallel to the rotation axis A-A of the rotating support 5 and parallel to the axis of the tailstocks 9.

Figure 7C:
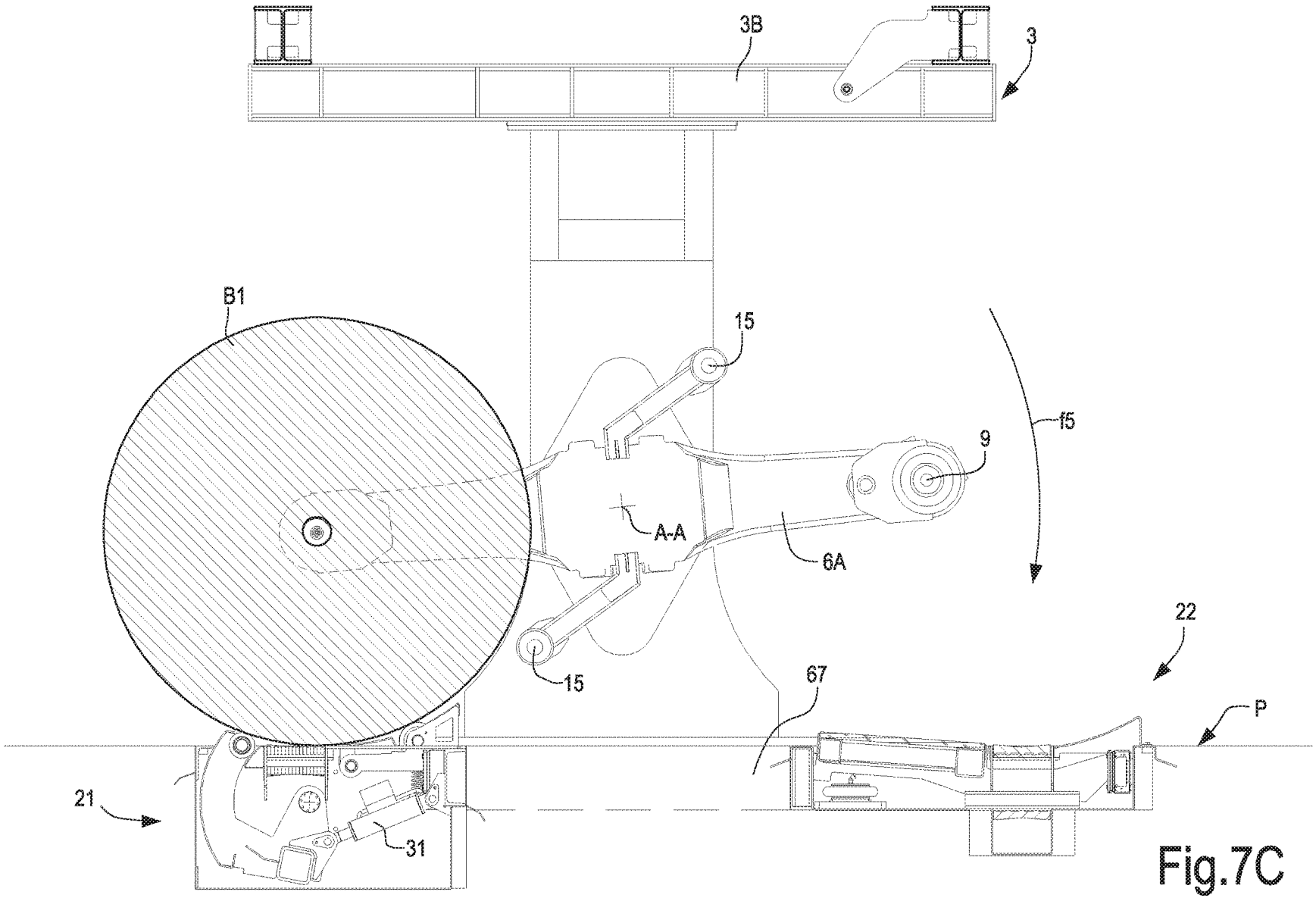

FIG. 7C shows the subsequent step, where, by keeping the reel B1 in the previously achieved position by means of the pusher 29, the arms 6A of the rotating support 5 are brought to such a position as to align the respective tailstocks 9 with the axis X-X of the reel B1. Once the position has been achieved, the tailstocks may be inserted in the tubular winding core of the reel B1.

Now, the reel B1 may be handled by means of the rotating support 5 according to the unwinding cycle provided for the unwinder 1 and not described.

As it is particularly clear from FIG. 1, where the contours of a plurality of reels 9 of variable diameters are shown, by means of the system described above it is possible to bring the axis X-X of each reel B, independently of the diameter thereof, always sufficiently precisely on the circular path C followed by the tailstocks 9 during the rotation of the rotating support 5. This position is uniquely defined by the abutment elements 35A, 35B.

Figure 7D:
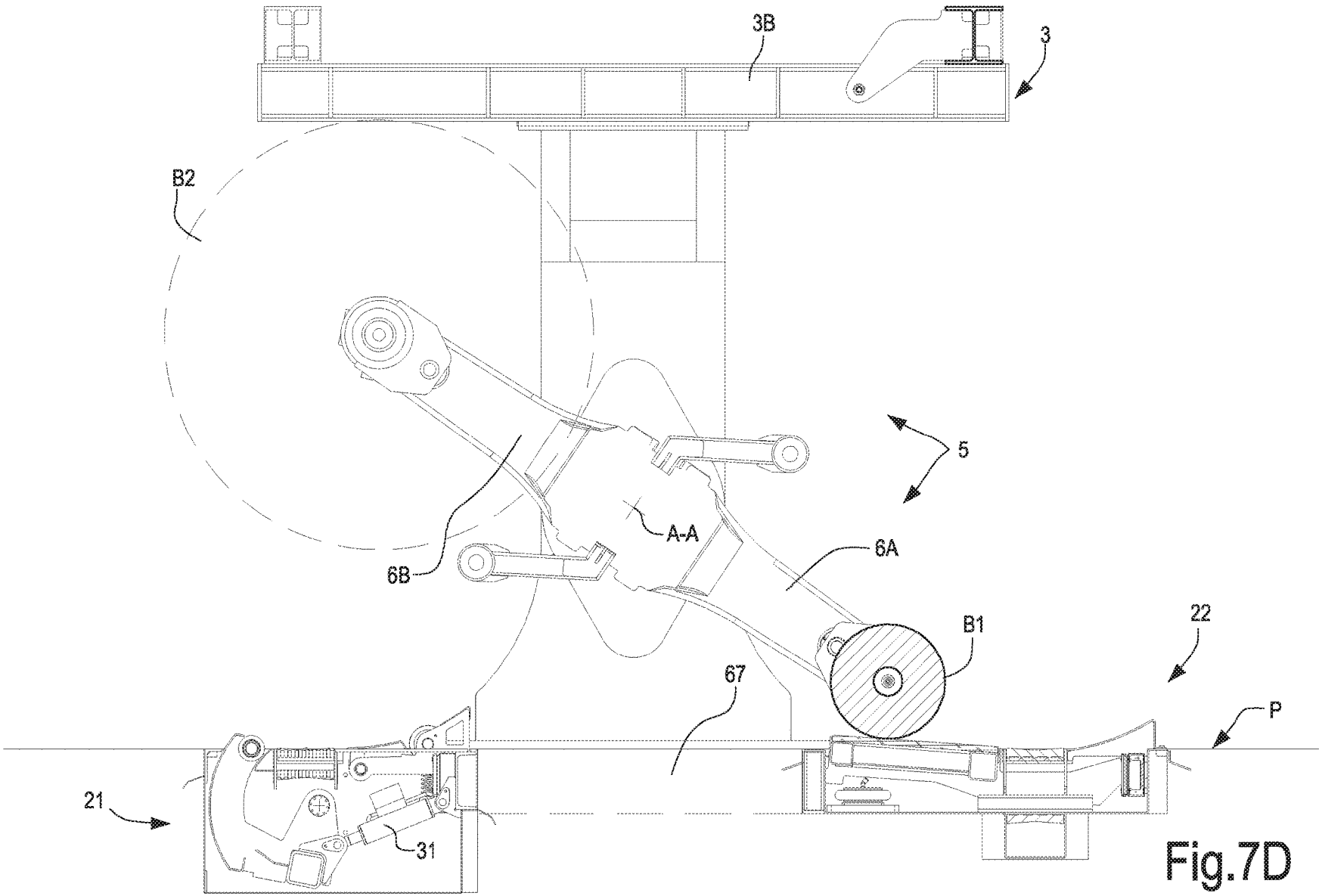
Figure 7E:
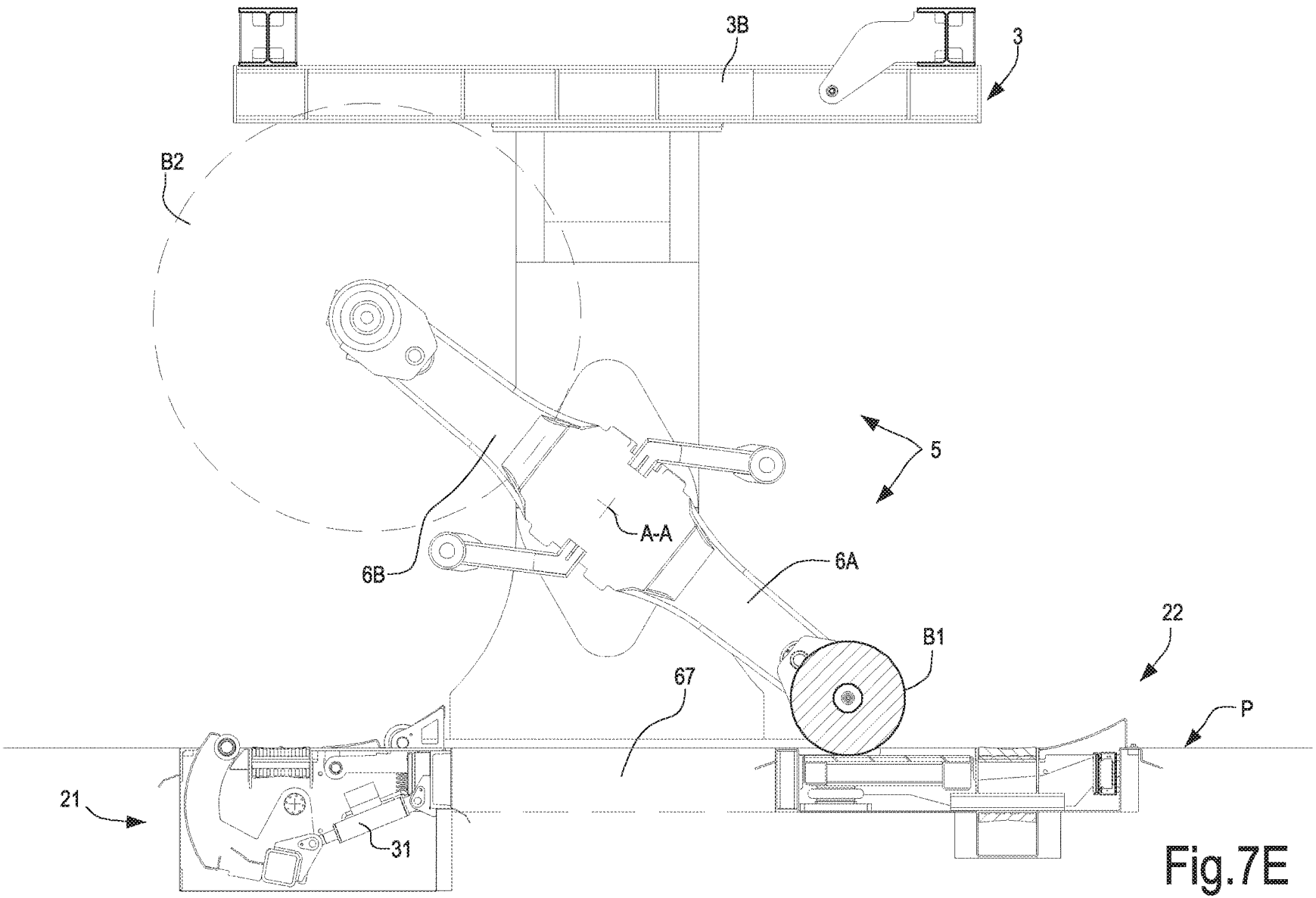
Figure 7F:
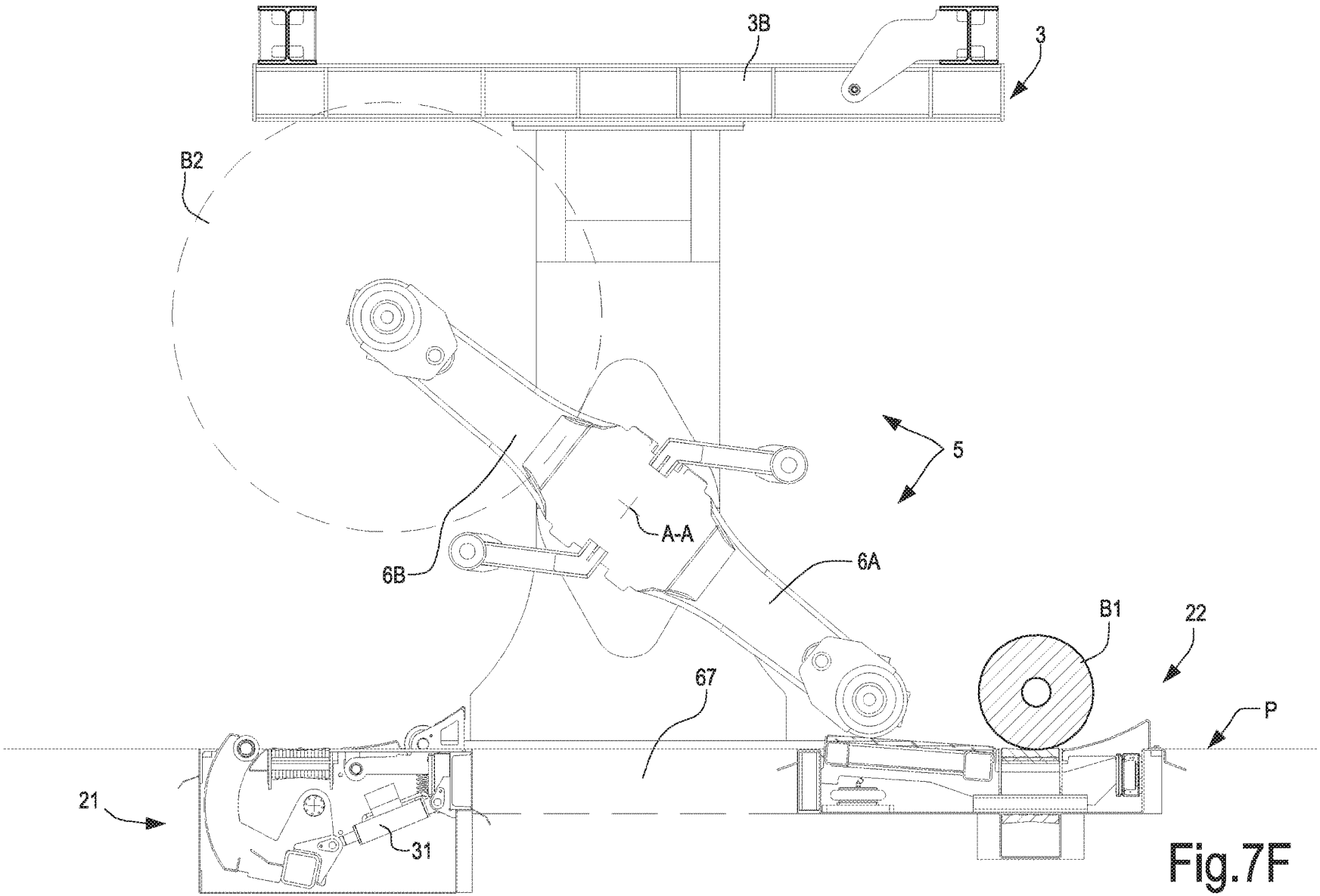

When a reel B1 shall be replaced with a new reel B2, the reel B1 is unloaded from the rotating support with a cycle represented in the sequence of FIGS. 7D to 7F. The replacement of the roll or reel B1 may be necessary because the reel B1 is nearly exhausted, or because a production order has been completed and the following one requires a reel of different web material, for example a web material of different transverse dimension, or of different grammage.

The reel B2 has been previously engaged by the tailstocks 9 of the pair of arms 6B with a sequence substantially equal to that described above with reference to FIGS. 7A to 7C to engage the reel B1 through the arms 6A.

FIG. 7D shows the moment when the rotation of the rotating support 5 brings the reel B into contact with the pivoting unloading surface 51. The pivoting unloading surface 51 is in the position of maximum inclination with respect to the horizontal, for example with an angle $\alpha 1=4°$.

In order to control the lowering movement of the reel B1 up to the suitable position for unloading it, it is possible to use the detectors 55, 57 instead of controlling the angular position of the rotating support 5. Namely, to control the angular movement of the rotating support 5 through the motor thereof may be particularly difficult due to the presence of two reels B1, B2 supported by the rotating support 5, the weights of which can significantly vary and are not known. In fact, the reel B1 may be unloaded when it is completely empty or when it is only partially empty, and shall be replaced, during the working process, with a reel 92 of different type in order to process a different production batch. The reel B2 may be, in turn, a new reel or a partially used reel, for example a reel partially used for a previous production cycle. The reels may also have different axial lengths and/or may be constituted by web material of different grammage. Due to all these factors, the weight distribution on the arms 6A, 6B of the rotating support 5 is not known, and therefore it is difficult to control the rotation of the support only by means of the rotation motor.

The detectors 55, 57 allow to modulate the rotation speed of the rotating support 5 according to the angular position taken by the pivoting unloading surface 51 under the thrust of the reel B1 that is gradually lowered, without the need for using the rotation motor. When the pivoting surface 51 has achieved the second angular position $\alpha 2$ (for example, approximately 2° with respect to the horizontal), the programmable central control unit 47 may send the rotation control motor a command for slowing down the rotating support 5. Finally, the rotation of the rotating support 5 is stopped upon the command of the programmable central control unit 47 when the detectors 55, 57 have detected that the unloading surface 51 has achieved an angular position $\alpha 3$ (for example 1° inclined with respect to the horizontal). This condition is illustrated in FIG. 7E. Now, the reel B1 may be released from the tailstocks 9, that retract from the tubular winding core of the reel B1, releasing the reel onto the pivoting unloading surface 51.

In the subsequent step, indicated in FIG. 7F, the pivoting unloading surface 51 is brought, through the actuators 53, from the angular position $\alpha 3$ again to the angular position $\alpha 1$, in order that the reel B1 rolls along the pivoting unloading surface 51 until to achieve the conveyor 61. This latter may be slightly shaped like an open V in order to form a cradle for housing the reel B1. The reel B1 is prevented from accidentally rolling beyond the position of the second conveyor 61 by means of the metal sheet 63 arranged at the opposite side of the second conveyor 61 with respect to the pivoting unloading surface 51. In order to have an optimal movement of the unloading surface 51, the pivoting axis C-C thereof is arranged at the same side of the second conveyor as the metal sheet 63.

At this point, the rotating support 5 may further rotate so as to bring the arms 6A towards the area where the positioning system 21 is arranged, where a new reel is taken. Simultaneously, the reel B2 engaged by the arms 6B is brought towards the unloading position 22.

In the floor P a pair of cavities 67 is provided, indicated in broken line in the sequence of FIGS. 7A to 7F, to allow the movement of the ends of the arms 6A, 6B and of the tailstocks 9 that, during the rotation around the axis A-A, achieve a height lower than the floor P.

In some embodiments, in order to optimize the operation of the device when reels B of particularly small diameter are loaded, the positioning system may comprise a curved metal sheet 26 (FIG. 2) on which the reels of smaller diameter are pushed in order to lift the center thereof up to a height sufficient for being engaged by the tailstocks 9.

Moreover, in order to optimize the operation of the unloading system when the diameter of the winding cores to be unloaded is particularly small, or when the reel is completely empty and the only winding core shall be unloaded, an angular position detector may be associated to the rotating support 5, configured to stop the rotation of the support in a position of minimum lowering. If the reel or the winding core engaged by the tailstocks 9 has such a small diameter that it does not touch the pivoting unloading surface 51 before the rotating support has achieved the position of minimum lowering, the rotation is anyway stopped, independently of the signal sent by the detectors 55, 57, and the tailstocks 9 are released from the winding core, which rolls along the pivoting unloading surface 51. In this way the risk of a collision between the tailstocks and the pivoting unloading surface is avoided.

The invention claimed is:

1. An unwinder for unwinding reels of web material, comprising:

a rotating support with a rotation axis and provided with engaging members for engaging the reels;

a reel positioning system for loading the reels onto the rotating support;

an unloading system for unloading the reels from the rotating support;

wherein the reel positioning system comprises a first conveyor for the reels and a pusher configured and arranged to push the reels from the first conveyor towards abutment members defining a pick-up position where a reel is taken by the rotating support; and wherein the reel positioning system and the unloading system are arranged at opposite sides of the rotating support.

2. The unwinder of claim 1, wherein the reel positioning system is configured so that, in the pick-up position, the reel is arranged with the axis thereof on approximately a circular path of the engaging members.

3. The unwinder of claim 1, wherein the first conveyor has a reel feeding movement substantially parallel to the rotation axis of the rotating support, and the pusher has a movement substantially orthogonal to the rotation axis of the rotating support.

4. The unwinder of claim 1, wherein the pusher comprises a pivoting arm, swinging around an articulation axis substantially parallel to the rotation axis of the rotating support.

5. The unwinder of claim 2, wherein the pusher comprises a pivoting arm, swinging around an articulation axis substantially parallel to the rotation axis of the rotating support.

6. The unwinder of claim 4, wherein the articulation axis is arranged at a height lower than the first conveyor.

7. The unwinder of claim 5, wherein the articulation axis is arranged at a height lower than the first conveyor.

8. The unwinder of claim 1, wherein the abutment members comprise two abutment elements for the reels, spaced from each other along a direction substantially parallel to the rotation axis of the rotating support.

9. The unwinder of claim 8, wherein the two abutment elements are resiliently biased, independently of each other, towards a first position, and are movable into a second position under the weight of the reel pushed by the pusher.

10. The unwinder of claim 8, wherein each abutment element is associated with a detector generating a signal as the abutment element achieves the second position.

11. The unwinder of claim 10, wherein each detector interfaces with a control unit configured to control movement of the pusher so that the pusher pushes the reel until both the abutment elements have achieved the second position.

12. The unwinder of claim 8, wherein each abutment element is mounted onto a respective oscillating member, resiliently biased in the first position by a respective resilient member.

13. The unwinder of claim 12, wherein the oscillating members, onto which the abutment elements are mounted, are hinged around an axis substantially parallel to the rotation axis of the rotating support.

14. The unwinder of claim 8, wherein each abutment element comprises an idle roller.

15. The unwinder of claim 1, wherein the unloading system comprises: an unloading surface pivoting around a pivoting axis substantially parallel to the rotation axis of the rotating support; and a second conveyor; wherein the unloading surface and the second conveyor are arranged so as to make reels roll from the rotating support along the unloading surface to the second conveyor.

16. The unwinder of claim 15, wherein the pivoting axis of the unloading surface is arranged at a height lower than a transport height of the second conveyor.

17. The unwinder of claim 15, wherein the unloading surface is associated with detecting members, configured to detect an angular position of the unloading surface.

18. The unwinder of claim 17, wherein the detecting members interface with a control unit configured to control movement of the rotating support and stop thereof in a position where the reel is released, said release position being defined according to the angular position of the unloading surface.

19. The unwinder of claim 15, wherein the unloading surface is functionally connected to at least one actuator arranged and configured to make the unloading surface pivot into a rejecting position for rejecting the reel towards the second conveyor.

20. The unwinder of claim 15, wherein the second conveyor is configured and arranged to move the reels in a direction substantially parallel to the rotation axis of the rotating support.

21. The unwinder of claim 15, wherein the unloading surface is arranged at a first side of the second conveyor, and the pivoting axis of the unloading surface is arranged at a second side of the second conveyor, the first side being nearer to the rotating support than the second side.

22. A method for handling a reel of web material by an unwinder comprising a rotating support with a rotation axis and provided with engaging members for engaging the reels; the method comprising steps as follows:

positioning, by a first conveyor, a reel to be loaded aligned with the rotating support;

pushing the reel from the first conveyor towards abutment members defining a pick-up position where the reel is taken by the rotating support;

engaging the reel by the engaging members of the rotating support and lifting the reel by the rotating support.

23. The method of claim 22, wherein the engaging members are movable along a circular path, and wherein, in the pick-up position, the reel is arranged with the axis thereof approximately on said circular path, independently of the reel diameter.

24. The method of claim 22, wherein the pushing of the reel from the first conveyor towards the abutment members comprises:

bringing the reel to abut against two abutment elements that are spaced from each other along a direction substantially parallel to the rotation axis of the rotating support, so as to bring each abutment element into a pick-up enabling position enabling the unwinder to take the reel;

when both the abutment elements are in a respective pick-up enabling position, generating an engagement enabling signal for engagement of the reel by the engaging members.

25. The method of claim 22, comprising:

providing an unloading system arranged at an opposite side of the rotating support with respect to the positioning system; said unloading system comprising an unloading surface pivoting around a pivoting axis substantially parallel to the rotation axis of the rotating support and a second conveyor;

unloading a reel from the rotating support onto the unloading surface;

rotating the unloading surface in an unloading rotation direction around the pivoting axis and making reels roll along the unloading surface up to the second conveyor.

26. The method of claim 25, wherein the unloading of the reel onto the unloading surface comprises:

rotating the rotating support by bringing the reel onto the unloading surface and causing the rotation of the unloading surface under the thrust of the reel in a direction opposite to the unloading rotation direction;

detecting the angular position of the unloading surface rotating under the thrust of the reel;

stopping the rotation of the rotating support as the reel has achieved a release position defined according to the angular position of the unloading surface.

* * * * *